United States Patent [19]

Forster

[11] 4,383,342

[45] May 17, 1983

[54] MATTRESS FOR A SITTING OR LYING PERSON

[76] Inventor: Peter Forster, Oberfürberger Strasse 73, 8510 Fürth, Fed. Rep. of Germany

[21] Appl. No.: 243,492

[22] Filed: Mar. 13, 1981

[30] Foreign Application Priority Data

Mar. 15, 1980 [DE] Fed. Rep. of Germany ..... 3010122

[51] Int. Cl.[3] ..... A47C 27/00; A61H 7/00

[52] U.S. Cl. ..... 5/432; 5/417; 5/448; 128/62 R; 297/460; 297/284; D24/36

[58] Field of Search ..... 5/417, 420, 436, 448, 5/432, 433; 128/62 R; 4/583; 297/460, 284; D6/201; D24/36

[56] References Cited

U.S. PATENT DOCUMENTS

| | | | |
|---|---|---|---|
| 1,510,647 | 10/1924 | Bomar | 4/583 |
| 1,904,039 | 4/1933 | Bruder | 5/420 |
| 2,742,957 | 4/1956 | Young | 5/475 |
| 3,681,797 | 8/1972 | Messner | 297/180 |
| 3,742,528 | 7/1973 | Munch | 5/465 |
| 3,974,532 | 8/1976 | Ecchuya | 5/448 |
| 3,990,742 | 11/1976 | Glass et al. | 297/284 |

FOREIGN PATENT DOCUMENTS

| | | | |
|---|---|---|---|
| 1241643 | 8/1960 | France | 5/436 |
| 2131448 | 10/1972 | France . | |
| 921098 | 1/1959 | United Kingdom | 5/417 |
| 2025234A | 1/1980 | United Kingdom | 5/448 |

*Primary Examiner*—Alexander Grosz

*Attorney, Agent, or Firm*—Hill, Van Santen, Steadman, Chiara & Simpson

[57] ABSTRACT

A molded elastic mattress is formed with a plurality of laterally directed ribs for coming into contact with a human body. The ribs are tilted with respect to the longitudinal axis to relieve pressure on the dorsal spine.

8 Claims, 7 Drawing Figures

MATTRESS FOR A SITTING OR LYING PERSON

BACKGROUND OF THE INVENTION

This invention concerns a cushion or mattress for a lying or sitting person. This cushion or mattress consists of a molded part made of permanent-elastic plastic material.

Cushions of a similar type are known which are used as mattress without relieving the intervertebral discs. Problems due to deformed or displaced intervertebral discs are a frequent reason for backache. This deficiency is often found with elderly people due to the intervertebral disc tissue having lost its elasticity as a result of the daily stress. In general, the high load on the dorsal spine is not even relieved during lying since most persons suffering from discopathy do not use a suitable mattress.

It is well known that the intervertebral discs are able to reabsorb fluid upon relieving load, i.e. by lengthening the dorsal spine. Due to this reason, devices for stretching or lengthening the dorsal spine have been proposed such as disclosed in German AS No. 2,015,440 and AS No. 2,646,306. The common stretching systems are very sophisticated and require the person to be held by a belt for a longer period, so that high forces can be applied. It will easily be understood that a person on this sort of apparatuses will not feel comfortable.

One object of this invention is to provide a mattress or cushion, which allows a comfortable attitude of the body and a relief of the intervertebral discs or stretching other parts of body for a longer period, as for example during night-time. Furthermore the design should be simple and cheap.

SUMMARY OF THE INVENTION

A molded elastic mattress is equipped with ribs or naps on the surface coming into contact with the person; at least some of these ribs or naps are sloping to the longitudinal axis. Due to these ribs or naps, the respective area of the body and in particular the dorsal spine are stretched and relieved. Production of this mattress is very easy, since it is made in one piece.

In the case of a bed mattress, the ribs in the area of the seat of the person are sloping towards the legs, whereas those in the lumbar region are almost perpendicular and the ribs or naps in the dorsal region are sloping towards the head. The tilted ribs or naps of different orientations ensures a uniform power transfer to the various regions of the body. Each of these suspension points is elastic, thus transferring power to the body, the amount of which depends on the load itself and the angle of the ribs or naps. The area with ribs or naps which is intended for the lumbar region may be a little bit higher than the others. As a person reclines on the mattress or rolls laterally along the mattress, such as for repositioning during sleep, the ribs or naps will go up upon relieving. When coming under load again, it is able to transfer a certain amount of power in the desired direction. Due to lying on this mattress or due to intentional or unintentional movements, a traction is generated, which in particular relieves the dorsal spine. This power is transferred from ribs or naps to the skin and the connective tissue to the muscles and the vertebra. The consequence will be a displacement of the connective tissue and a slight massage of the connective tissue.

In order to improve the power transfer in the neck region, a wedge-shaped pad is preferably provided for engaging the cervical vertebra.

In instances where the inventive cushion is used as back-rest of a seat, the ribs or naps may point upward in direction to the head from the lumbar region, when a person is leaning on this cushion. This version was particularly designed for a car seat. The ribs or naps serve as support, so that the weight of the upper part of the body does not act against the back, but is simultaneously distributed via the dorsal area to the seat itself. Using this car seat, the pressure against the back-rest can be intensified by pushing against the steering wheel, thus obtaining another relieving motion for the dorsal spine due to these ribs and naps. Depending on the position of the back-rest of the car seat, the dorsal spine will be stretched more or less.

A further embodiment of the invention concerns an exchangeable module being inserted into the central area of a normal mattress. It may be desirable to cover this module with an elastic material.

DESCRIPTION OF THE PREFERRED EMBODIMENTS

Figure 1:
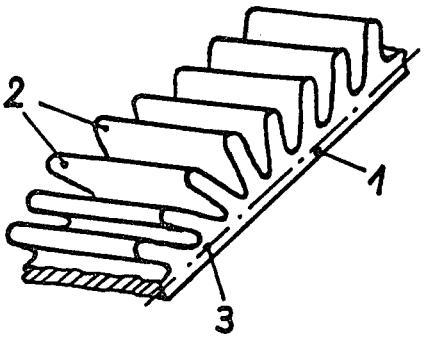
FIG. 1 is a broken-away perspective view of a ribbed mattress constructed in accordance with the present invention.

FIG. 1 shows a molded mattress part (1) made of permanent-elastic sponge rubber and equipped with lateral ribs (2) some of which are tilted towards the longitudinal axis (3).

Figure 2:
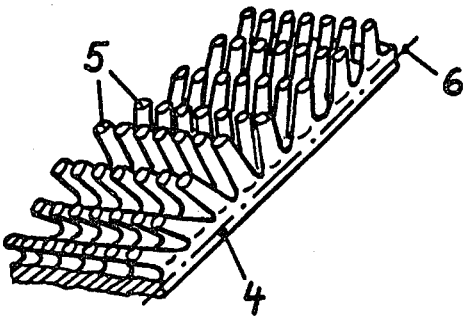
FIG. 2 is a broken-away perspective view of a ribbed mattress wherein the rib lines each comprise a plurality of individual rib or nap members constructed in accordance with the present invention.

FIG. 2 shows a molded mattress part (4), which is equipped with a lot of naps (5). These naps (5) are assembled in parallel groups to form individual rib rows. Every row intersects the longitudinal axis (6) under a certain angle. For some rows of naps, this angle differs from 90°, so that same of these rows are not perpendicular to the longitudinal axis (6).

Figure 3:
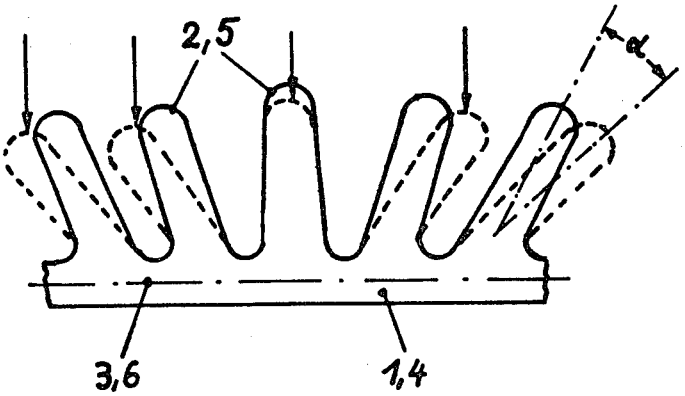
FIG. 3 is a broken-away side elevational view of the rib lines for the mattresses of FIG. 1 or 2.

FIG. 3 shows the ribs (2) or naps (5) shown in FIGS. 1 and 2, respectively in their initial position, i.e. with no load. The position of the ribs (2) or naps (5) under load-conditions is shown in dotted lines. The weight of the body will act in the direction of the arrows shown in FIG. 3. The angles are shown, by which these rows of ribs or naps rotate due to the weight of the body. From this angular motion, the stretching force acting on the dorsal spine is derived.

Figure 4:
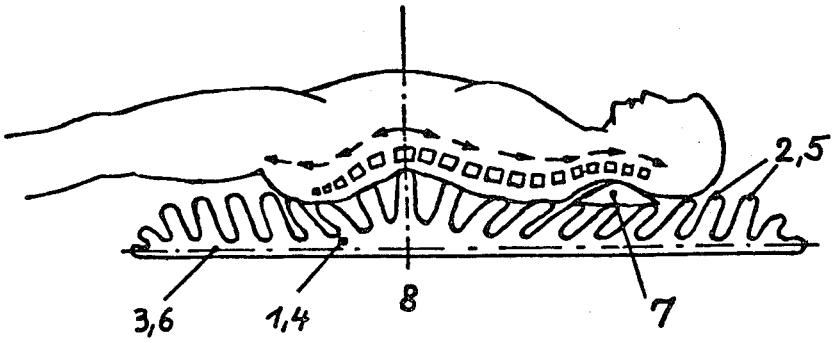
FIG. 4 is a side elevational view of a person laying on a ribbed mattress constructed in the manner shown in FIG. 1 or 2.

FIG. 4 shows a person lying on a full length mattress (1, 4) which generates a traction on the dorsal spine by means of the ribs or naps (2, 5) in direction of the arrows of FIG. 4. This traction is intensified by a wedge-shaped pad (7) in the cervical region of the neck.

FIG. 4 shows that the traction acting on the dorsal spine is formed by ribs or naps (2, 5) which in the area of the back of the person point in direction of the legs, whereas those in the lumbar region (8) are almost perpendicular to the longitudinal axis and those in the back area point to the head.

Figure 5:
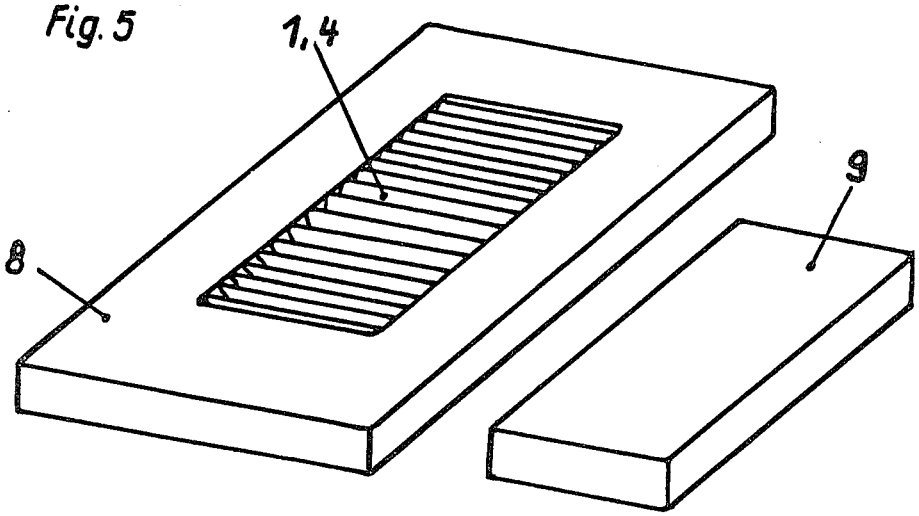
FIG. 5 is a perspective view of a modular bed mattress for incorporating a ribbed mattress portion constructed in the manner of FIG. 1.

FIG. 5 shows a bed mattress (8) which is equipped with an exchangeable mattress module constructed according to FIGS. 1 and 4. This module can be exchanged with a conventional plain portion (9). The bed mattress, including the exchangeable module portion, can be covered by a sheet.

Figure 6:
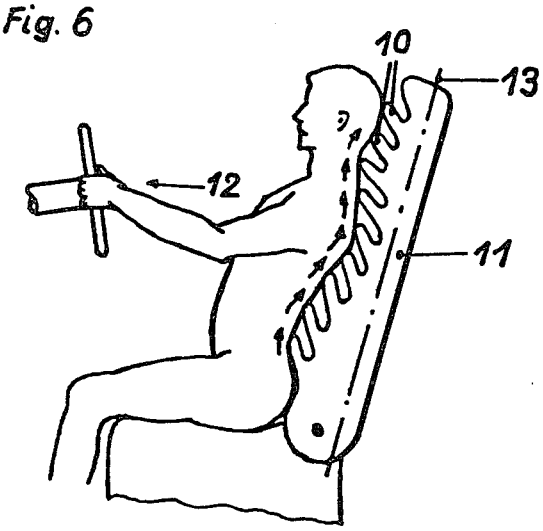
FIG. 6 is a side elevational view of a person leaning upright against a car seat back-rest portion incorporating a ribbed cushion constructed in accordance with the present invention.

FIG. 6 shows a version of the present invention wherein a back-rest cushion (11) for a car seat utilizes tilted ribs (10), such that the ribs or naps (10) will point up beginning from the lumbar region, when a person is sitting on this seat and leans back against the back-rest. The ribs or naps will slope towards the longitudinal axis (13). Concerning the position in FIG. 6, which shows a back-rest (11) slightly tilted back, the intervertebral discs will be relieved upon leaning back or in particular upon pushing against the steering wheel (12).

Figure 7:
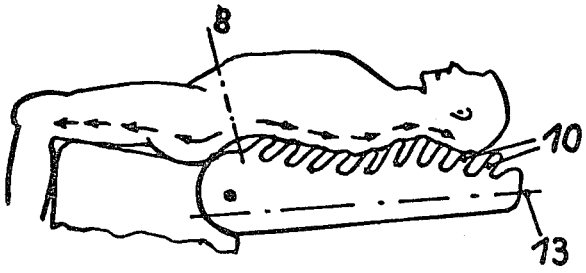
FIG. 7 is a side elevational view of the car seat back-rest portion of FIG. 6 in the reclined position.

In the horizontal position of the back-rest (11) as shown in FIG. 7, the effect of the ribs or naps (10) is similar to that of the ribs or naps (2, 5) with the system according to FIG. 4. The traction is performed by the ribs or naps (10), so that a counteracting force is applied for the suspension of the back and upper thigh.

Due to the weight of the body, the ribs or naps of the single-piece mattress will form angular levers, which are able to transmit traction force to the body of a lying or sitting person, as soon as it is depressed by the body. With respect to the full-length mattress arrangement shown in FIGS. 1–4, with ribs or naps oriented to the head or to the feet, the traction will be divided in the center, i.e. in the lumbar region. The system according to FIGS. 1 to 4 is particularly intended for domestic use, because it can be used at any time in place without any set up. The mattress should be a little bit wider than the body of the person and may have a thickness of 8 cm for example. In consequence no space problems will have to be encountered.

Although various minor modifications may be suggested by those versed in the art, it should be understood that I wish to embody within the scope of the patent warranted hereon all such modifications as reasonably and properly come within the scope of my contribution to the art.

I claim:

1. A device for supporting a reclining human body comprising a longitudinally extending pad made of elastic material and having a series of lateral rows of raised ribs for supporting the human body, the free ends of the ribs disposed below the lumbar region of the human body all being tilted relative to the longitudinal axis of said pad toward the legs of the human body and the free ends of the ribs disposed above the lumbar region all being tilted relative to the longitudinal axis of said pad toward the head of the human body such that a tensile force is exerted on the spinal column of the human body.

2. The device of claim 1, wherein the free ends of the ribs contacting the lumbar region are substantially perpendicular to the longitudinal axis of said pad.

3. The device of claim 1, further comprising a wedge-shaped pad means for overlying the ribs beneath the cervical vertebra region of the human body.

4. The device of claim 1, wherein said pad is a one-piece surface.

5. The device of claim 4, wherein said pad is in the form of a removable module in a bed mattress.

6. The device of claim 1, wherein said pad is in the form of a removable module in a bed mattress.

7. A device for supporting the back of a sitting human body comprising a vertically disposed pad made of elastic material and having a series of lateral rows of raised ribs for supporting the back, the free ends of the ribs beginning at and above the lumbar region of the human body all being tilted upward toward the head of the human body such that a tensile force is exerted on the spinal column of the human body.

8. The device of claim 7, wherein said pad is a one-piece surface.

* * * * *